US006539677B1

(12) United States Patent
Lanka

(10) Patent No.: US 6,539,677 B1
(45) Date of Patent: Apr. 1, 2003

(54) FORM BRACE WITH ADJUSTABLE FACE

(76) Inventor: Richard I. Lanka, 1306 Meadow Wood La., Hudson, OH (US) 44236

( * ) Notice: Subject to any disclaimer, the term of this patent is extended or adjusted under 35 U.S.C. 154(b) by 0 days.

(21) Appl. No.: 09/931,350

(22) Filed: Aug. 16, 2001

Related U.S. Application Data

(60) Provisional application No. 60/292,103, filed on May 18, 2001.

(51) Int. Cl.[7] ..... E04G 21/04

(52) U.S. Cl. ..... 52/127.2; 52/149; 52/749.13; 248/354.3; 249/33

(58) Field of Search ..... 52/127.2, 149, 52/749.1, 749.13; 248/354.3, 351; 182/82, 150, 224, 230; 249/33, 53 R, 205, 207, 210, 219.1, 219.2

(56) References Cited

U.S. PATENT DOCUMENTS

| | | | | |
|---|---|---|---|---|
| 2,313,880 A | * | 3/1943 | Leggett, Sr. | 249/27 |
| 2,511,584 A | | 6/1950 | Hill | 249/27 |
| 2,687,268 A | | 8/1954 | Hawes | 254/101 |
| 2,777,660 A | | 1/1957 | Albrecht | 248/354.5 |
| 2,832,559 A | | 4/1958 | Hillberg | 254/100 |
| 2,945,662 A | | 7/1960 | Jennings | 254/100 |
| 3,154,833 A | | 11/1964 | Kimball | 249/219.1 |
| 3,171,627 A | | 3/1965 | Tapley et al. | 248/354.3 |
| 3,504,880 A | | 4/1970 | Toms | 248/354.3 |
| 3,728,838 A | | 4/1973 | Stout | 52/742 |
| 3,817,006 A | | 6/1974 | Williams | 52/122 |
| 3,908,956 A | | 9/1975 | Gates | 249/40 |
| 4,000,592 A | | 1/1977 | Kelly | 52/149 |
| 4,068,427 A | | 1/1978 | Camardo | 52/127 |
| 4,070,833 A | | 1/1978 | Hancock | 52/148 |
| 5,388,663 A | | 2/1995 | Phillippe et al. | 182/82 |
| 6,065,254 A | | 5/2000 | Lanka | 52/127.2 |
| 6,212,830 B1 | | 4/2001 | MacKarvich | 52/127.2 |
| 6,247,273 B1 | | 6/2001 | Nickel | 52/127.2 |

* cited by examiner

*Primary Examiner*—Carl D. Friedman
*Assistant Examiner*—Naoko Slack
(74) *Attorney, Agent, or Firm*—Fay, Sharpe, Fagan, Minnich & McKee LLP

(57) ABSTRACT

An adjustable support bracing system for an upright structure includes a substantially vertical main frame and a support plate member pivotally secured to the main frame. The support plate extends on a first side of the main frame and provides supporting engagement of the upright structure. An adjustment device is connected to the main frame and bears on the support plate for selectively pivoting the support plate to a desired support angle. An adjustable length leg extends on a second side of the main frame opposite the first side.

25 Claims, 7 Drawing Sheets

FORM BRACE WITH ADJUSTABLE FACE

CROSS-REFERENCE TO RELATED APPLICATION

The present application claims the priority benefit under 35 U.S.C. §119(e) of the U.S. Provisional Application Serial No. 60/292,103, filed May 18, 2001. Said Provisional Application is incorporated herein by reference in its entirety.

FIELD OF THE INVENTION

The present invention relates to the art of support braces. It finds more particular application in the production of an adjustable support brace for use in commercial or home construction for temporarily supporting newly constructed masonry walls.

In this regard, the support braces are utilized to bolster masonry walls formed on the site (i.e., cast-in-place, etc.) during construction. For example, the present invention is useful for supporting concrete forms while the moist concrete is allowed to cure within the forms. This type of process is utilized to produce monolithic poured walls. Additionally, the braces can be used for supporting newly assembled masonry brick or block walls of approximately 8 feet or higher in order to inhibit wind damage and the like.

However, it will be appreciated that the invention has other applications, such as holding up and supporting any vertical or upright structure or wall being formed, for providing a scaffolding support, as well as other, entirely unrelated applications and environments.

BACKGROUND OF THE INVENTION

Concrete interior or exterior walls are generally produced through the use of two or more concrete form walls that are set up in parallel and are interconnected by spacer bars. The spacer bars, along with exterior support braces, retain the forms in a parallel relationship while the concrete is being poured and the initial cure cycle is initiated.

To support the forms and to resist movement during concrete pouring or curing, wooded support braces can be utilized. However, the braces used in such wooded brace or prop systems are generally loosely constructed and provide non-uniform support. Additionally, such wooded braces are difficult to use in soft or hard soil conditions and/or result in a waste of lumber. Furthermore, wooden braces are time consuming to assemble and disassemble.

Recently, several types of reusable bracing systems have been developed. Commonly, such support braces include a vertical rail abutting the form wall and an extensible leg which is secured to the ground or floor. Such braces often provide supports upon which scaffolding may be erected. The extensible leg is adjusted at an appropriate length to support the forms in a true vertical position.

In certain instances, the form and/or brace may shift slightly due to the hydrostatic pressure of the concrete poured between the wall forms, wind, and various other construction loads. Because the current supports are very difficult to relocate once the concrete has been poured, it is known to compensate for hydrostatic and other loads by providing making fine adjustments to the extensible leg.

Also, it is known to initially set up the bracing system with the form wall slightly out of the vertical plane in the direction of the bracing system. It is generally easier to correct the plumb of the uncured wall in this direction since such support braces are adapted to push on the wall rather than pull it.

In any event, current bracing systems generally require two persons to adjust the uncured wall to vertical after pouring. That is, the adjustments usually require a first person on a staging or scaffolding platform with access to the top of the wall to ensure that concrete is being poured correctly, e.g., relative to a chalk line or the like. A second person on the ground and within reach of a fine adjustment mechanism on the extensible leg makes adjustments in response to instructions communicated by the first person.

The present invention contemplates a new and improved apparatus and method which overcomes the above-referenced problems and other problems present in support brace construction.

SUMMARY OF THE INVENTION

In a first aspect, an adjustable support bracing system for an upright structure includes a substantially vertical main frame and a support plate member pivotally secured to the main frame. The support plate extends on a first side of the main frame and provides supporting engagement of the upright structure. An adjustment device is connected to the main frame and bears on the support plate for selectively pivoting the support plate to a desired support angle. An adjustable length leg extends on a second side of the main frame opposite the first side.

In a second aspect, an adjustable support bracing system for an upright structure includes a substantially vertical main frame and an adjustable length leg member pivotally connected to the main frame and extending on a second side of the main frame opposite the first side. The adjustable length leg includes a first leg section including a first end pivotally attached to the main frame, and a second leg section including a first end in telescoping engagement with a second end of the first leg section opposite the first end of the first leg section. At least one fastener is provided for securing the first and second leg sections at one of a plurality of relative positions to achieve a desired length the second leg section. The fastener(s) include an elongate flat spring aligned generally parallel with the first leg section, and having a first end anchored to an exterior surface of the first leg section and a second end opposite the first end. A retaining pin attached to the second end is urged radially inwardly by the flat spring. A hole formed in the first leg section is aligned with and receives the retaining pin. A plurality of spaced apart holes are formed in the second leg section and a selected one of the spaced apart holes receives the retaining pin when the selected hole in the second leg section is aligned with the hole in the first leg section.

In a third aspect, a method of bracing a wall includes positioning a bracing member adjacent the wall, the bracing member having a substantially vertical main frame and a support plate member pivotally secured the main frame. The support plate is disposed between the frame rail and the wall to provide supporting engagement of the wall. The bracing member is secured to the floor with a floor-engaging, adjustable-length leg member pivotally connected to the main frame and extending downwardly and away from the wall. The support plate is then adjusted with an adjustment device connected to the main frame and bearing on the support plate so that the wall is supported at a preselected support angle.

In a fourth aspect, a method of constructing a concrete wall includes building a form wall assembly comprising two generally parallel form walls defining a space therebetween and positioning a temporary bracing member adjacent the wall. The temporary bracing member includes a substantially vertical main frame and a support plate member pivotally secured the main frame and disposed between the frame rail and the wall to provide supporting engagement of the wall. The bracing member is secured to a floor with a floor-engaging, adjustable-length leg member pivotally connected to the main frame and extending downwardly away from the wall. Fluid concrete is poured into the space between the form walls and, before the poured concrete is allowed to cure, the support plate is adjusted with an adjustment device connected to the main frame and bearing on the support plate so that the wall is supported at a preselected support angle.

One advantage of the present invention is that a reusable support brace for construction is easily collapsible and transportable. Once the forms for the interior or exterior walls are assembled and/or the brick or block wall is provided, the support brace of the present invention can be easily engaged, thereby providing vertical support to the walls as the moist concrete is allowed to cure.

Another advantage of the present invention is that a pivoting wall-bearing face provides fine adjustments to the plumb of the wall after the concrete has been poured.

Yet another advantage is realized when the adjustment to the pivoting face is accessible to a person on an elevated staging platform with access to the top of the wall, thus eliminating the need for a second person on the is ground.

Another advantage is that the bracing units are compact, easily transported, and may be reused essentially indefinitely.

Still another advantage is that a fine or continuous adjustment mechanism for the extensible leg is optionally eliminated, thus reducing cost and simplifying construction of the unit.

Yet another advantage resides in that the present bracing system uses interchangeable pivoting support plates, which can be exchanged for use with different manufacturers' block styles.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
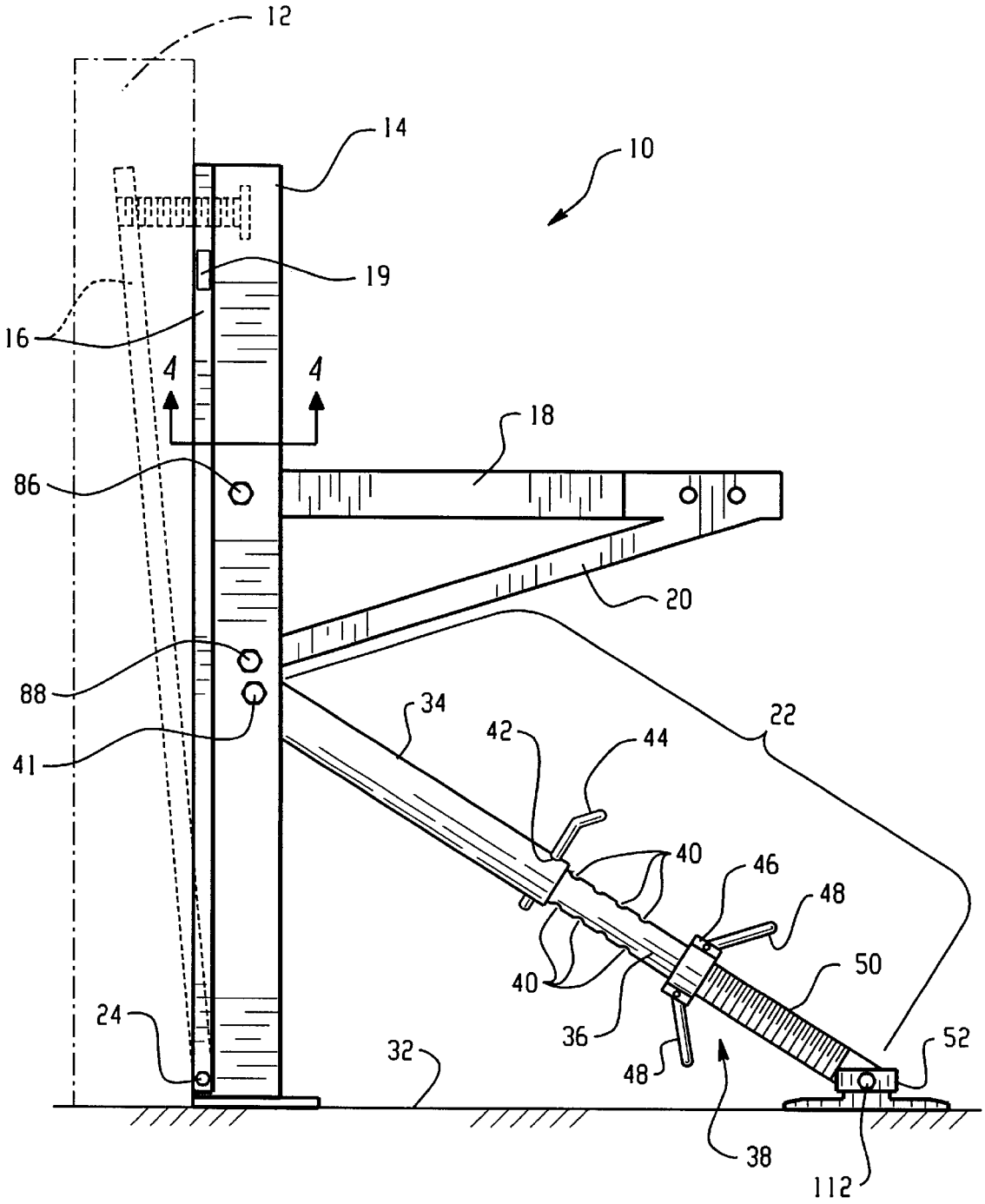
FIG. 1 is a side view of an exemplary, unfolded support brace system of the present invention.

Turning now to the drawings, wherein the showings are for purposes of illustrating the preferred embodiments of the invention only and not for limiting the same, FIG. 1 shows a portable wall support brace 10.

The brace 10 is shown in an assembled and unfolded state next to a side wall of a form structure 12, referenced in phantom. Alternatively, form structure 12 can also represent a newly assembled brick, block, or other type of masonry wall.

The brace 10 includes a vertical main frame rail 14, a hinged support plate 16, an optional fold down ledge 18 with a swinging ledge support 20, and an extensible leg support member 22. The main rail 14 and the pivoting plate 16 are fastened at pivot point 24, which comprises a hinge, pin, bolt, or other fastening means permitting a pivoting engagement between the plate 16 and the main frame rail 14. The plate 16 moves, in a hinged rotating manner, away from a first, upright position, shown in solid lines in FIG. 1, in which the plate is substantially parallel to the main frame rail 14. Although the pivot point 24 is illustrated at or near the level of the floor 32, providing the pivot point at elevated positions along the vertical rail is contemplated as well.

Figure 2:
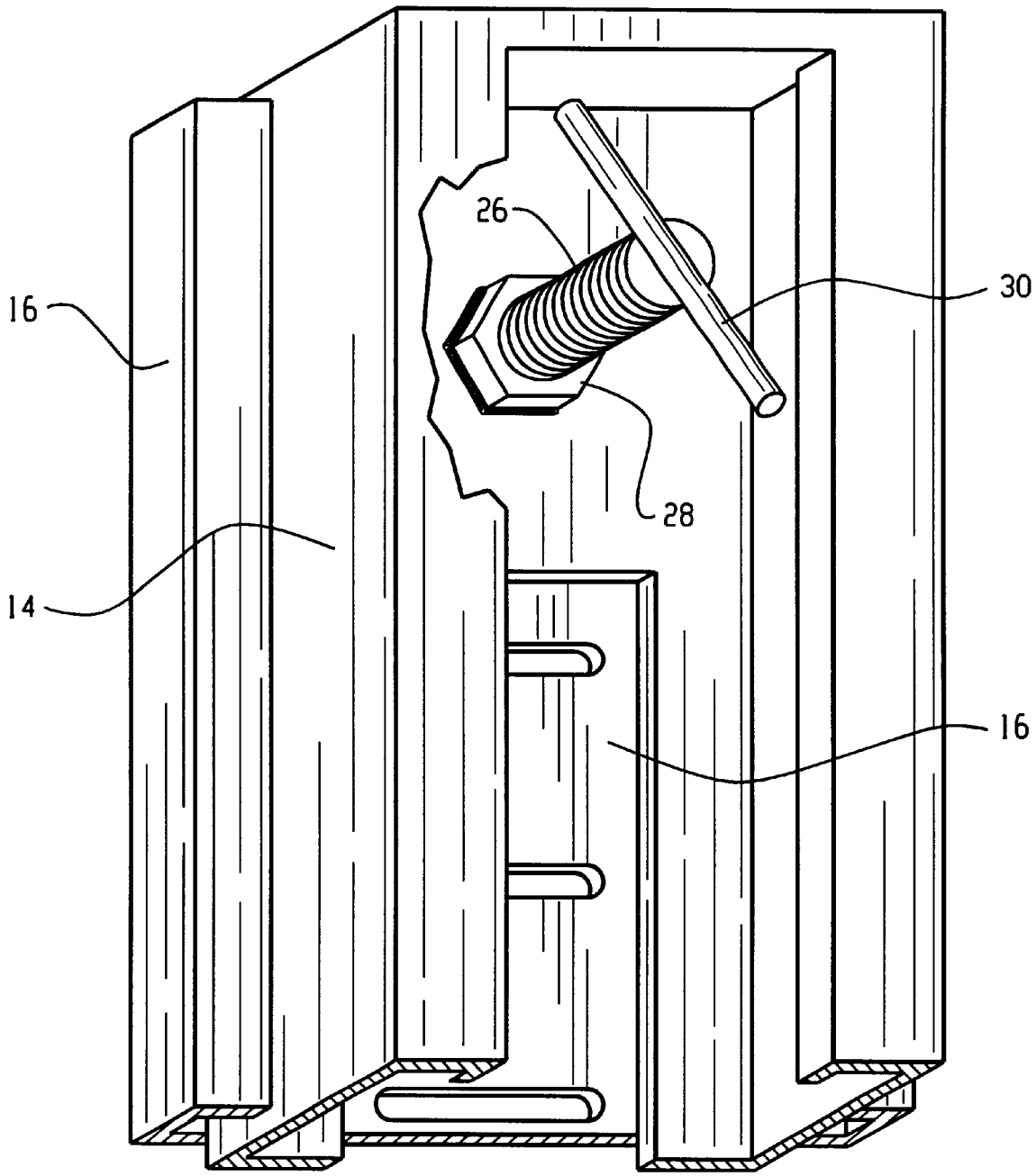
FIG. 2 illustrates a preferred support plate pivot adjustment device of the present invention.

With continued reference to FIG. 1 and additional reference to FIG. 2, the hinged movement of the plate 16 is controlled by a threaded shaft 26 bearing on the plate. The threaded shaft is moved in the direction along its axis by rotating the shaft in a complimentary threaded hole or bore 28 in the main frame rail 14. In this manner, the plate 16 can be accurately positioned after the brace 10 is installed by extending or retracting the shaft 26. In preferred embodiments, the threaded shaft is of sufficient length to provide an adjustable pivot angle of up to about five degrees, most preferably up to about three degrees. For an eight foot support brace, a three degree pivot angle corresponds to about a 13 cm (5 inch) range of motion at the top of the brace.

In the preferred embodiment, a handle or knob 30, which is a T-handle in the illustrated embodiment, is provided for manual turning of the shaft for positioning of the plate 16. Additional means for rotating the shaft are contemplated as well. For example, the threaded shaft 26 may be adapted to connect to a powered device, such as a portable drill or driver for effecting rotation of the shaft.

In an especially preferred embodiment, the bearing end of the threaded shaft 26 is rotatably attached to the form bearing plate 16, e.g., using a pin-type or other rotatable fastener. This limits the range of motion between the first, upright position, shown in solid lines, and a second position, shown in phantom in FIG. 1.

In a preferred manner of operation, the support 10 is initially braced against the form 12 with the plate 16 in its first, substantially upright position, parallel to the main frame rail 14. When liquid concrete is poured between the forms, the hydrostatic pressure and other loads may cause the form to shift out of a true vertical position. The operator may then check the plumb of the wall before the concrete sets and accurately readjust it to a true vertical position as necessary.

The plate 16 optionally includes an integral level device 17 to allow for easy alignment of the plate 16 in a true vertical position during use.

Preferably, the threaded shaft 26 is positioned at the top of the main frame rail 14. In this manner, a single worker has easy access to both the pivot plate adjustment knob as well as to the top of the wall. This allows a single person standing on an elevated platform, such as staging placed on the optional ledge support 18, to make the necessary adjustments to maintain the wall at a true vertical position. The same person can, simultaneously, inspect the top of the wall to ensure proper pouring and curing of the cement or perform other construction work, with easy access to the adjustment knob.

Placement of the adjustment knob at the top of the wall also provides the greatest mechanical advantage. However, placement of the threaded shaft at other vertical positions along the main frame rail are also contemplated, for example, at a height that can also be reached by a worker standing on the ground or floor 32.

The illustrated extensible leg 22 includes an upper section 34, a middle section 36, and a lower section 38. Upper section 34 is attached in pivoting manner to the main frame rail 14 via pivot member 41, which is a hinge, pin, bolt, or the like.

Upper leg section 34 telescopically receives the middle leg section 36, which may be secured at a plurality of relative positions. The middle section 36 comprises a plurality of spaced apart holes 40 along its length. The length of extensible leg 22 is coarsely adjusted by aligning selected holes 40 with holes 42 in the upper leg portion and securing the sections 34 and 36 with a retaining pin 44.

Figure 3A:
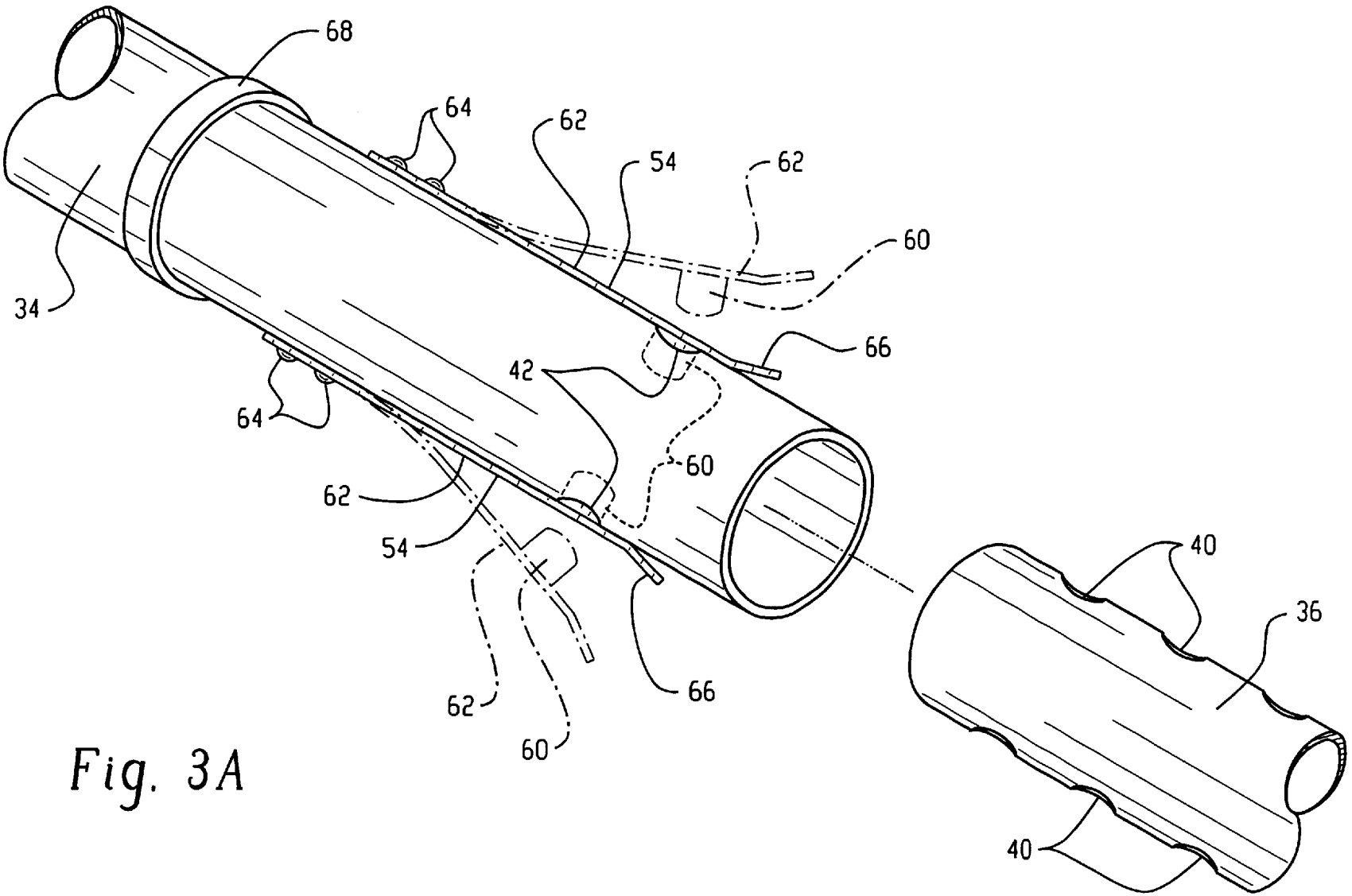
FIGS. 3A–3C illustrate a preferred device for securing telescoping leg sections at a desired length.
Figure 3B:
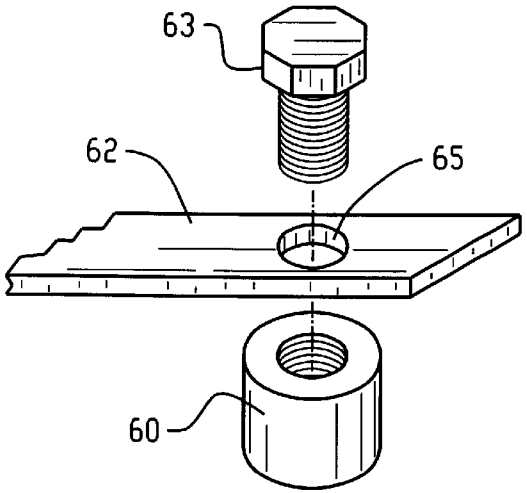
Figure 3C:
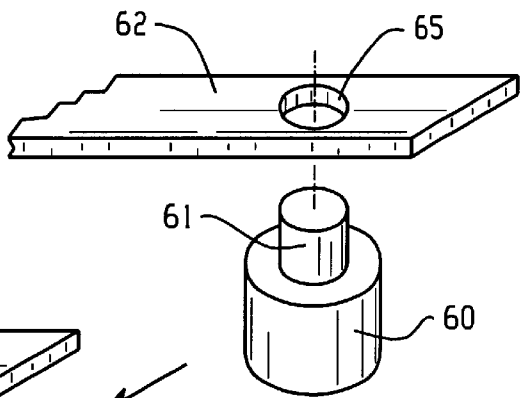
Figure 3C:
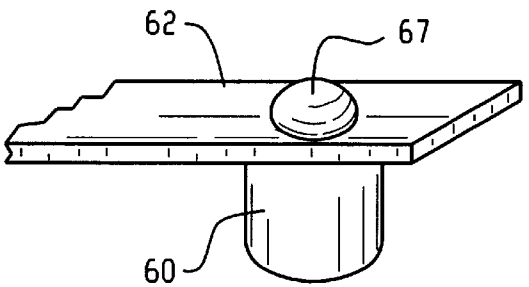

FIGS. 3A–3C illustrate a preferred method of securing the telescoping leg members 34 and 36. A pair of retaining pins 60 engage openings 42 in tube section 34. The pins 60 also engage a selected pair of holes 40 in the leg section 36 when it is received in the tube section 34.

Each of the pins 60 is attached to a leaf spring 62, which is fastened to the exterior of the tube section 34 by fasteners 64, such as rivets or other fastener which does not interfere with the telescoping movement between the leg members 34 and 36.

Fastening of the pins 60 to the respective flat springs 62 may be done by a number of methods, including but not limited to the exemplary embodiments of FIGS. 3B and 3C. As shown in the embodiment of FIG. 3B, attachment of the retaining pins 60 to the respective leaf springs 62 is performed by screw-type fastener 63 engaging both the pin 60 and a hole 65 formed in the flat spring 62. In the FIG. 3C embodiment, pin 60 is provided with a shaft 61 which extends through a hole 65 formed in the flat spring 62. A protruding portion of the shaft 61 is mechanically peened over, e.g., using a hammer or the like, to produce a flanged portion 67 to provide a secure retention of the pin 60.

The leaf springs 62 are aligned parallel to the longitudinal axis of the tube 34 and urge the pins 60 inwardly toward the holes 42. To adjust the length of the extensible leg 22, the springs 62 are pulled outwardly away from the leg section 34 (as shown in phantom) and the section 36 is extended or retracted until the desired pair of holes 40 are in alignment with the holes 42 in the section 34. The springs are then released to secure the sections via retaining pins 60. After the length is adjusted, an optional retaining ring 68 disposed circumferentially about the tube section 34 is slid over the leaf springs 62 to secure the pins from retracting or moving out.

In an especially preferred embodiment, the distal ends 66 of the springs 62 are curved or bent outwardly away from the tube section 34 which facilitates grasping of the leaf springs for adjustment of the length, provides a stop which prevents the safety from passing completely over the length of the springs, and provides a spring bias against which the retaining ring 68 can be wedged and secured. In addition to or as an alternative to the bent distal ends 66, a mechanical stop (not shown) can be fastened at the distal end of at least one of the springs 62 for preventing the ring 68 from passing completely beyond the distal ends of the leaf springs. In a further alternative embodiment, in addition to or as an alternative to the bent distal ends 66, a spacer ring or bushing (not shown) is attached to the distal, inward facing surface of each leaf spring, with the retaining pin 60 extending inwardly therefrom. In this manner, the distal ends of the springs 62 are deflected radially away from the tube section 34, restricting the travel of the optional retaining ring 68 as well as increasing the bias tension of the spring members.

Other methods of securing the telescoping sections 34 and 36 are also contemplated, as would be known to those skilled in the art.

Bottom portion 38 of the leg 22 is preferably continuously adjustable relative to the middle section 36 to provide fine adjustment of the length of the extensible leg 22. A length adjusting device or member 46 includes an internally threaded receptacle and periscope folding handles 48. The collar 46 engages complimentary threaded shaft 50 which is extended and retracted when the collar 46 is rotated, depending on the direction of rotation. A preferred extensible leg 22 is described in my U.S. Pat. No. 6,065,254, the entire contents of which, including the specification and drawings, are incorporated herein by reference.

The threaded screw body 50 is pivotally fastened to a footer base 52. The footer base 52 is positioned on the ground 32, which may be earthen, a concrete slab, etc. The footer base 52 can be wedged against the ground or floor, or, optionally, may be staked or bolted into place.

Figure 4:
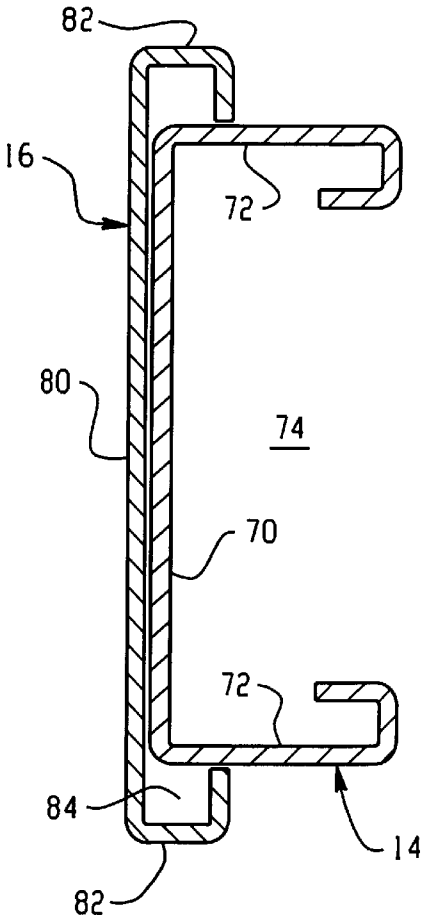
FIG. 4 is a cross-sectional view taken along the lines 4—4 in FIG. 1, illustrating the channel structure of the main frame rail and the nesting arrangement of the main frame and the pivoting support plate when the pivoting plate is in its upright position.

The main frame rail 14 is preferably made of a steel or aluminum channel material or the like and is shown in greater detail in FIG. 4. The main frame rail 14 includes a front face plate 70, opposing side plates 72, thus defining a cavity 74. The channel structural shape provides strength while also providing the cavity 74, into which the support leg 22 and the optional fold down ledge 18 may be collapsed into. The main frame rail 14 optionally further includes a handle device (not shown) for carrying the portable wall support brace 10.

The pivoting face plate 16 likewise is formed from either a plate or channel material. In the illustrated embodiment, a channel configuration is shown, a including a front face plate 80 and opposing sides 82, thereby defining a channel 84. In this preferred embodiment, the channel 84 is of sufficient size to at least partially retain the main frame rail 14 in a nesting manner when the pivoting plate is in its upright position.

The preferred embodiment includes the optional fold down ledge 18 and fold down ledge support 20. Each is pivotally attached to the main frame rail 14 via pivoting fasteners 86 and 88, respectively. Fasteners 86 and 88 may be pins, bolts, hinges, and the like, and are preferably carriage bolts. However, other known pivoting mechanical fastening devices may also be used.

Figure 5:
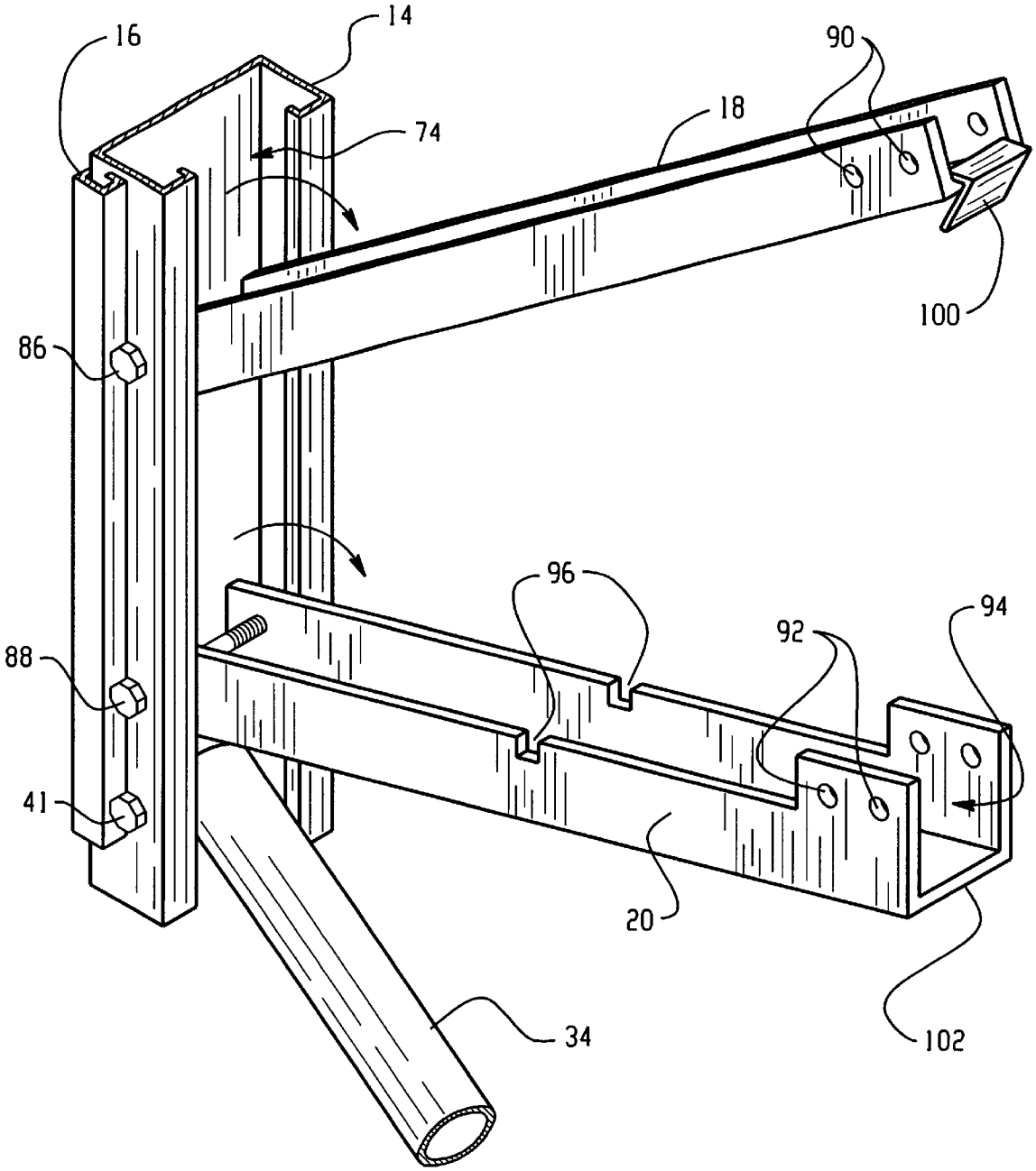
FIG. 5 illustrates a preferred folding staging support bracket attached to the main frame rail.

In reference now to FIG. 5, a preferred embodiment of the fold down ledge 18, and the support 20 therefor, are illustrated in greater detail. The distal end of the fold down ledge 18 includes a downward extending plate 100 which hooks or latches onto the distal end 102 of the support brace 20. The swinging ledge 18 includes holes 90 which are aligned with holes 92 in the support brace 20 when the hook 100 and support brace end 102 are engaged. Pins, bolts, or the like, can be passed through the aligned sets of holes to additionally secure the members, and/or can be used for safety rail attachments (not shown) to prevent falling from a staging platform supported by the ledge 18 during use of the brace 10. Safety rail attachments can also be secured to other locations on the brace 20, ledge 18, and/or main frame 14.

Optionally, the fold down ledge 18 and swing ledge support 20 are constructed in such a manner which allows the components to be pivotally collapsed into the rear cavity 74 of the main frame rail 14. In the illustrated embodiment, the ledge 18 swings upwardly into the channel 74. The support 20 likewise swings upwardly into the channel 74 and includes a channel 94, allowing the ledge support 20 to fit over the ledge 18 when the ledge and support are in the collapsed position. Optional cutouts 96 in the arm 20 accommodate the bolt 86 for clearance to fold when the support member 20 is in its upright, collapsed position. The ledge 18 and the support 20 can be retained in the collapsed position, e.g., during transport and handling, by tolerencing the dimensions of the ledge 18 and the channel 94 to provide a snug, frictional fit therebetween. Alternatively, a latch, snap-fit engagement, or similar mechanism can be provided to provide secure retention of the ledge 18 and the support 20 when collapsed into the housing channel 74.

Nesting or collapsing of the pivoting leg 22, the ledge 18, and the support 20 is also shown and described in the above incorporated U.S. Pat. No. 6,065,254.

Figure 6:
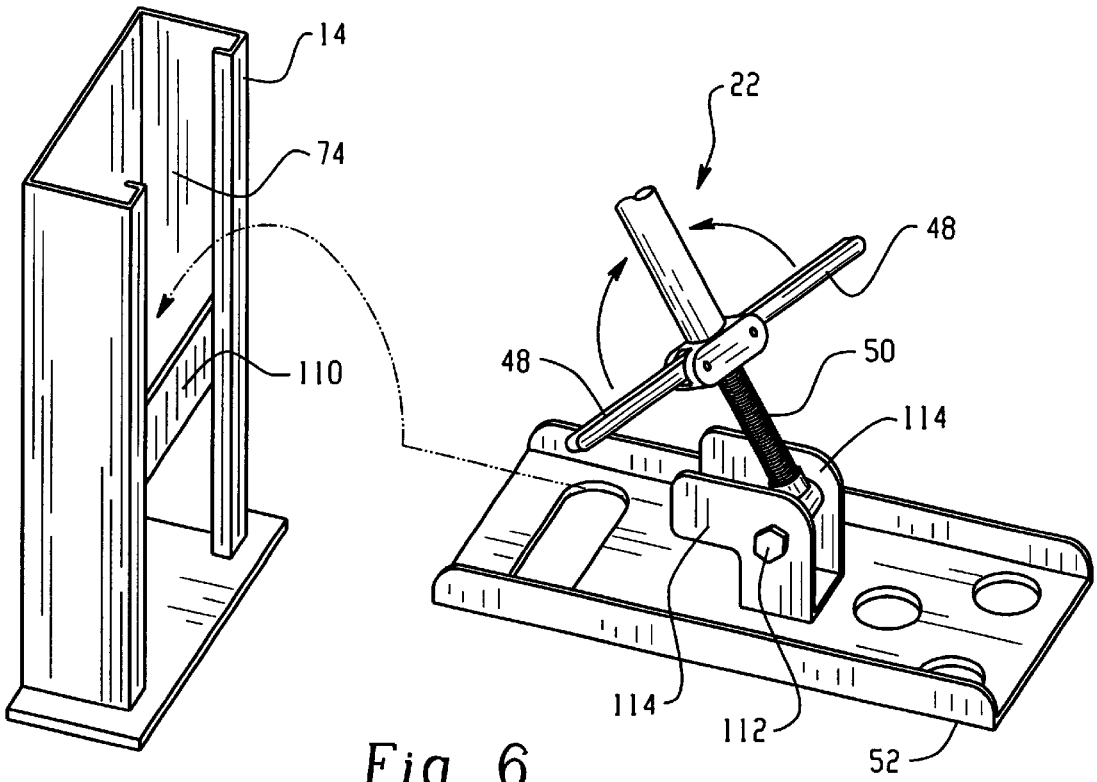
FIG. 6 illustrates a fastening system for retention of the adjustable length leg when the brace system is collapsed.

Referring now to FIG. 6, there is shown an especially preferred embodiment, in which an optional fastener is provided to secure the pivoting leg 22 to the frame rail 14 when the leg 22 is in the folded position. When the extensible leg 22 is retracted and pivoted into the channel 74 about the pivot point 41 (FIG. 1). Handles 48 are pivoted upward into alignment with the leg 22 and the base plate 52 is pivoted about the pivot point 112, which may be a bolt, pin, hinge, or other type of pivoting joint, so that latching members 114 are secured behind a bar or plate 110, or other latch device, fastened to the frame rail 14. The plate 110 is fastened to the frame rail 14 via a welded juncture, bolts, or the like. Alternatively, a pin or bolts traversing the channel 74 may be used in place of the plate 110.

Figure 7:
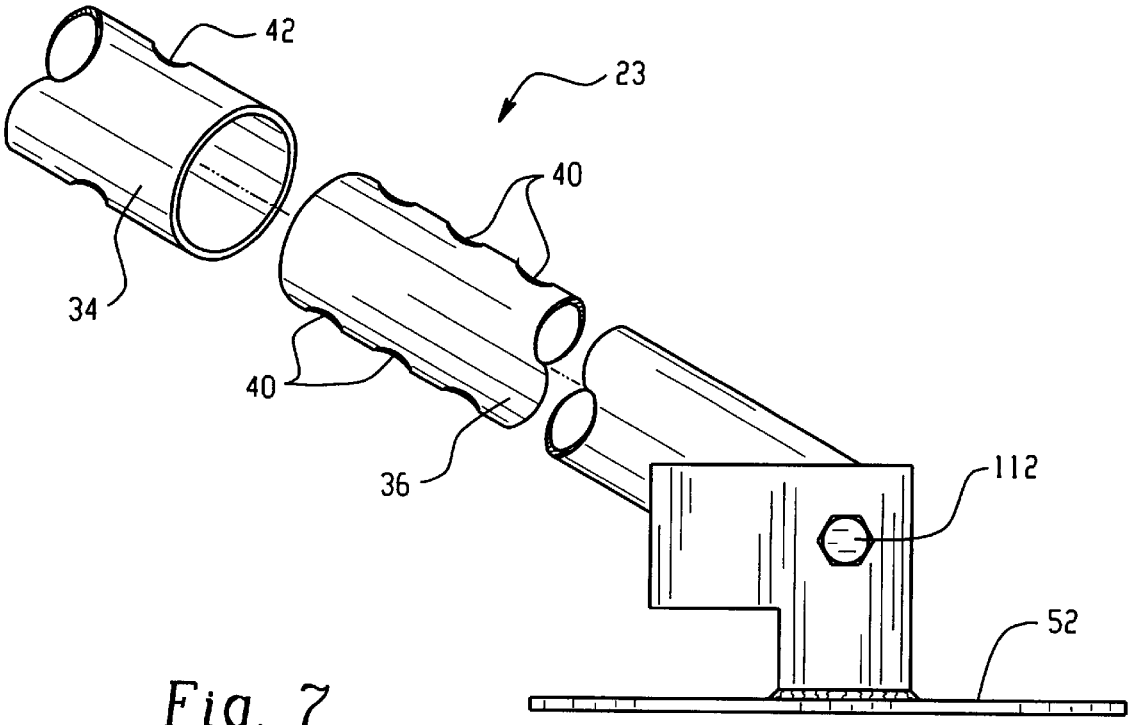
FIG. 7 is a fragmentary view of an alternative, two-segment extensible leg for use in the support brace of the present invention, wherein a fine length adjustment device is not provided.

A number of alternative extensible legs may also be employed in conjunction with the present invention. As an example, referring now to FIG. 7, an alternative embodiment extensible leg 23 is shown. The leg 23 replaces the leg 22 (FIG. 1), and includes two telescoping sections 34 and 36. The leg 23 eliminates the lower leg section 38 and the base plate 52 is attached in pivoting fashion directly to segment 36, as shown. Since adjustments to the plumb of the wall can be made using the pivoting plate 16 by a single person, e.g., a person standing on a staging erected on the platform 18, the need for making of fine adjustments to the length of the extensible leg, e.g., by a second person on the ground at the direction of a first person with access to the top of the wall, is obviated.

Figure 8:
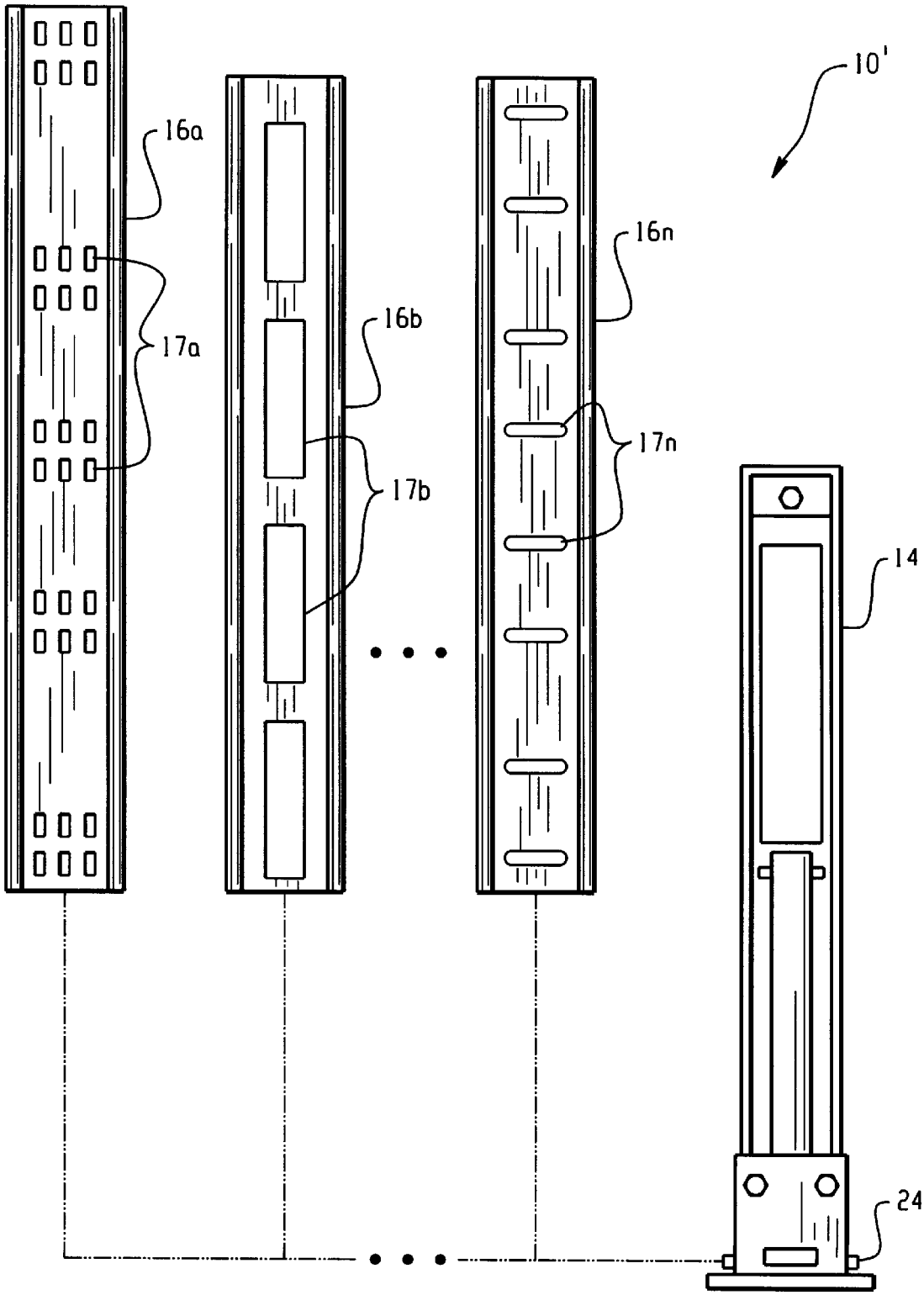
FIG. 8 illustrates a bracing system of the present invention employing multiple interchangeable hinged support plates.

Referring now to FIG. 8, there is shown a support brace system 10' in accordance with the present invention having multiple, detachable hinge plates 16*a,* 16*b,* up to 16*n.* The hinge plates 16*a*–16*n* are fastened at pivot point 24 via a carriage bolt, pin or other removable pivoting-type fastener. Where an optional rotatable retaining member is employed at the upper portion to limit the pivot range as discussed above, it too is removable. The interchangeability of the hinge plate provides the beneficial result that a single channel structure 14 and its attached leg and staging support bracket can be readily adapted to accomodate the requirements of manufacturer-specific or customized wall forms. In this manner, by selecting a one of the hinge plates 16*a*–16*n* having appropriately sized and spaced cutouts 17*a*–17*n* formed therein, virtually any make of wall form can be accomodate. While not intended to be limiting of the invention, representative wall form systems with which the subject bracing system can be adapted by selection of an appropriately configured hinge plate include, for example, Pink Rigid (Owens Corning), Consulwal, ICE Block, Polysteel, REWARD, Therm-O-Wall, Conform SWF, Durisol, Foam Wonder Wall, Faswall, IMF Wall Systems, Insulform, New Energy Wall System, Perma-Form, Reddi-Form, Reddi-Wall, tech Block, VOT Block, EnergyLock, Keeva, and others.

The invention has been described with reference to the preferred embodiment. Obviously, modifications and alterations will occur to others upon reading and understanding the proceeding detailed description. It is intended that the invention be construed as including all such modifications and alterations insofar as they come within the scope of the appended claims or the equivalents thereof.

Having thus described the preferred embodiments, the invention is now claimed to be:

1. An adjustable support bracing system for an upright structure, comprising:

a substantially vertical main frame;

a support plate member pivotally secured to the main frame and extending on a first side of the main frame for supporting engagement of the upright structure;

an adjustment device connected to the main frame and bearing on said support plate for selectively pivoting the support plate to a desired support angle;

an adjustable length leg member pivotally connected to the main frame and extending on a second side of the main frame opposite the first side.

2. The bracing system of claim 1, wherein the adjustment device comprises:

a nut fastened to the main frame having internal helical threads; and a shaft having a longitudinal axis aligned perpendicular with respect to said main frame, the shaft having external helical threads formed along at least a portion of its length, the external threads complimentary to and rotatably engaging said internal threads, the shaft having a first end for bearing against the support plate member and moving along said axis in response to rotation, thereby imparting a pivoting movement to the plate.

3. The bracing system of claim 2, the adjustment device further comprising:

a fastener rotatably connecting said first end of the threaded shaft to the support plate.

4. The bracing system of claim 3, the threaded shaft further comprising:

means for rotating the threaded shaft, said means attached to a second end of the threaded shaft opposite said first end.

5. The bracing system of claim 1, further comprising a staging support bracket attached to the main frame, the staging support bracket adapted to receive a staging platform spanning the space between said bracing system and an adjacent like bracing system.

6. The bracing system of claim 5, wherein the adjustment device is located on the main frame at a position accessible to a person standing on the staging platform.

7. The bracing system of claim 5, the staging support bracket comprising:

a horizontal ledge having a first end pivotally attached to the main frame rail and a second end distal the first end;

a support brace having a first end pivotally attached to the main frame rail and a second end distal the first end;

the second end of the horizontal ledge releasably engaging the second end of the support brace when the staging support bracket is in use.

8. The bracing system of claim 7, wherein the main frame includes three connected vertical walls defining a channel, and further wherein each of said horizontal ledge and said support brace are pivotally received into said channel when the staging support bracket is not in use.

9. The bracing system of claim 8, further comprising:

means for retaining said horizontal ledge and said support brace within said channel.

10. The bracing system of claim 9, wherein said retaining means includes a frictional engagement between said channel walls and at least one of said horizontal ledge and said support brace.

11. The bracing system of claim 1, wherein the adjustable length leg includes:

a first leg section including a first end pivotally attached to the main frame;

a second leg section including a first end in telescoping engagement with a second end of the first leg section opposite the first end of the first leg section; and at least one fastener for securing the first and second leg sections at one of a plurality of relative positions to achieve a desired length.

12. The bracing system of claim 11, wherein said first leg section telescopically receives said second leg section, and further wherein the at least one fastener includes:

an elongate flat spring aligned generally parallel with the first leg section, the flat spring having a first end anchored to an exterior surface of the first leg section and a second end opposite the first end;

a retaining pin attached to said second end and urged radially inwardly by said flat spring;

a hole formed in the first leg section aligned with and receiving the retaining pin; and a plurality of spaced apart holes formed in said second leg section, a selected one of said spaced apart holes receiving the retaining pin when the selected hole in the second leg section is aligned with the hole in the first leg section.

13. The bracing system of claim 11, wherein the main frame comprises three connected vertical walls defining a channel, and further wherein said adjustable length leg is received into the channel when the bracing system is not in use.

14. The bracing system of claim 13, further comprising:

a fastener for securing the leg within the channel when the bracing system is not in use.

15. The bracing system of claim 11, further comprising:

a third leg section comprising an externally threaded shaft having a first end rotatably engaging a second end of the second leg section opposite the first end of the second leg section, said second end of the second leg section including an internally threaded member rotatably receiving the threaded shaft to selectively shorten or lengthen the adjustable length leg when said threaded shaft is respectively rotated in opposite directions.

16. The bracing system of claim 11, further including a base plate pivotally attached to an end of the length adjustable leg opposite the main frame for securing the leg to the floor.

17. The bracing system of claim 1, further comprising:

a level device for indicating a true vertical position.

18. The bracing system of claim 1, further comprising:

a handle for carrying the bracing system.

19. The bracing system of claim 1, further comprising:

a plurality of interchangeable, dissimilarly configured support plates.

20. The bracing system of claim 1, wherein the upright structure is an insulated poured concrete wall.

21. The bracing system of claim 1, wherein the upright structure is an insulated concrete form wall.

22. An adjustable support bracing system for an upright structure, comprising:

a substantially vertical main frame;

an adjustable length leg member pivotally connected to the main frame and extending on a second side of the main frame opposite the first side, the adjustable length leg including a first leg section including a first end pivotally attached to the main frame, and a second leg section including a first end in telescoping engagement with a second end of the first leg section opposite the first end of the first leg section; and at least one fastener for securing the first and second leg sections at one of a plurality of relative positions to achieve a desired length said second leg section, the at least one fastener including:

an elongate flat spring aligned generally parallel with the first leg section, the flat spring having a first end anchored to an exterior surface of the first leg section and a second end opposite the first end;

a retaining pin attached to said second end and urged radially inwardly by said flat spring;

a hole formed in the first leg section aligned with and receiving the retaining pin; and a plurality of spaced apart holes formed in said second leg section, a selected one of said spaced apart holes receiving the retaining pin when the selected hole in the second leg section is aligned with the hole in the first leg section.

23. The bracing system of claim 22, further comprising:

a third leg section comprising an externally threaded shaft having a first end rotatably engaging a second end of the second leg section opposite the first end of the second leg section, said second end of the second leg section including an internally threaded member rotatably receiving the threaded shaft to selectively shorten or lengthen the adjustable length leg when said threaded shaft is respectively rotated in opposite directions.

24. A method of bracing a wall, comprising:

positioning a bracing member adjacent the wall, said bracing member comprising a substantially vertical main frame and a support plate member pivotally secured the main frame and disposed between a frame rail and the wall to provide supporting engagement of the wall;

securing the bracing member to a floor with a floor-engaging, adjustable-length leg member pivotally connected to the main frame and extending downwardly in a direction away from the wall; and adjusting the support plate, with an adjustment device connected to the main frame and bearing on said support plate, so that the wall is supported at a preselected support angle.

25. A method of constructing a concrete wall, comprising:

building a form wall assembly comprising two generally parallel form walls defining a space therebetween;

positioning a temporary bracing member adjacent the wall, said bracing member comprising a substantially vertical main frame and a support plate member pivotally secured the main frame and disposed between the frame rail and the wall to provide supporting engagement of the wall;

securing the bracing member to a floor with a floor-engaging, adjustable-length leg member pivotally connected to the main frame and extending downwardly in a direction away from the wall;

pouring fluid concrete into the space between said form walls;

before the poured concrete is allowed to cure, adjusting the support plate, with an adjustment device connected to the main frame and bearing on said support plate, so that the wall is supported at a preselected support angle.

* * * * *